US010342305B2

(12) United States Patent
Yep

(10) Patent No.: US 10,342,305 B2
(45) Date of Patent: Jul. 9, 2019

(54) INTERCHANGEABLE RING

(71) Applicant: New Atlantic Assets Limited, Tortola (VG)

(72) Inventor: Mau Koung Yep, Hong Kong (HK)

( * ) Notice: Subject to any disclaimer, the term of this patent is extended or adjusted under 35 U.S.C. 154(b) by 67 days.

(21) Appl. No.: 15/676,829

(22) Filed: Aug. 14, 2017

(65) Prior Publication Data

US 2019/0045891 A1 Feb. 14, 2019

(51) Int. Cl.
*A44C 17/02* (2006.01)
*A44C 9/00* (2006.01)

(52) U.S. Cl.
CPC ..... *A44C 9/0053* (2013.01); *A44C 17/0208* (2013.01); *A44C 17/0225* (2013.01)

(58) Field of Classification Search
CPC ..... A44C 9/00; A44C 9/0053; A44C 17/02; A44C 17/0208; A44C 17/0216; A44C 17/0225
USPC ..... 63/29.1, 30
See application file for complete search history.

(56) References Cited

U.S. PATENT DOCUMENTS 651,876 A * 6/1900 Meyer ..... E05D 11/00 16/312
3,115,758 A * 12/1963 Eberle ..... A44C 9/00 24/338
3,933,011 A * 1/1976 DiGilio ..... A44C 17/0208 63/29.1
4,982,581 A * 1/1991 Furuyama ..... A44C 17/0216 24/303
5,077,989 A * 1/1992 Dillabaugh ..... A44C 17/0216 24/574.1
5,115,649 A * 5/1992 Amber ..... A44C 17/04 63/26
5,727,399 A * 3/1998 Bergagnini ..... A44C 9/0023 63/15.1
6,490,886 B1 * 12/2002 Steinhauer ..... A44C 9/00 63/15
7,913,356 B2 * 3/2011 Duan ..... H04M 1/0216 16/303
2011/0179823 A1 * 7/2011 Moody ..... A44C 9/00 63/4
2017/0055646 A1 * 3/2017 Samanta ..... A44C 17/0225

* cited by examiner

*Primary Examiner* — Emily M Morgan
(74) *Attorney, Agent, or Firm* — Novoclaims Patent Services LLC

(57) ABSTRACT

An interchangeable ring having a main ring which has a ring loop. The ring loop has an inner surface portion, an outer surface portion, and a through cavity formed as a space surrounded by the inner surface portion. The interchangeable ring also has an interchangeable stone setter having a spring loader operatively engaged with the main ring, a connector, and an engaging stone setter which is selectively configured between an unengaged position which the engaging stone setter detaches from the connector through the spring loader, and a locking position which the connector engages with the engaging stone setter through the spring loader.

2 Claims, 8 Drawing Sheets

INTERCHANGEABLE RING

BACKGROUND OF THE PRESENT INVENTION

Field of Invention

The present invention relates to a ring, and more particularly to a jewel ring with an interchangeable feature such then a user may selectively interchange the jewel ring ornament article as a personal customized luxury item.

Description of Related Arts

There are many conventional jewel ring designs. The most common ring is just a simple circular ring forming a through cavity in which a user may insert his/her finger through it. Since this design could only be worn in a single way, the display effect is extremely limited. If the user gets bored with wearing the same jewel ring with the same display every day, it is necessary for the user to switch to another jewel ring.

Some of the jewel rings are customized by mounting different gems or diamonds. Mounting different gems or diamonds is usually the most effective way to customize a jewel ring as the gems or diamonds are usually extremely eye-catching. Thus, different gems or diamonds can significantly enhance the display effect of the ring. Conventional design jewel rings with gems or diamonds are often designed and manufactured so that the gems or diamonds are fixed on the ring itself and are not interchangeable. A major disadvantage is that the users would have to purchase a completely new ring if they would like to wear and display other gems or diamonds.

As one may see from the above, there are problems with these conventional design jewel rings. Thus, there is a need to invent a single jewel ring which provides more customizations in which the user may enjoy wearing it on a daily basis without switching to another jewel ring.

SUMMARY OF THE PRESENT INVENTION

The present invention provides an interchangeable jewel ring which a user may selectively interchange the display ornament article for customization.

In one aspect of the present invention, it provides an interchangeable ring, comprising:

a main ring having a ring loop, wherein the ring loop has an inner surface portion, an outer surface portion, and a through cavity formed as a space surrounded by the inner surface portion; and an interchangeable stone setter provided on said outer surface portion, and comprising:

a spring loader operatively engaged with said main ring;

a connector; and an engaging stone setter, wherein said interchangeable stone setter is selectively configured between an unengaged position which said engaging stone setter detaches from said connector through said spring loader, and a locking position which said connector engages with said engaging stone setter through said spring loader.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

Figure 1:
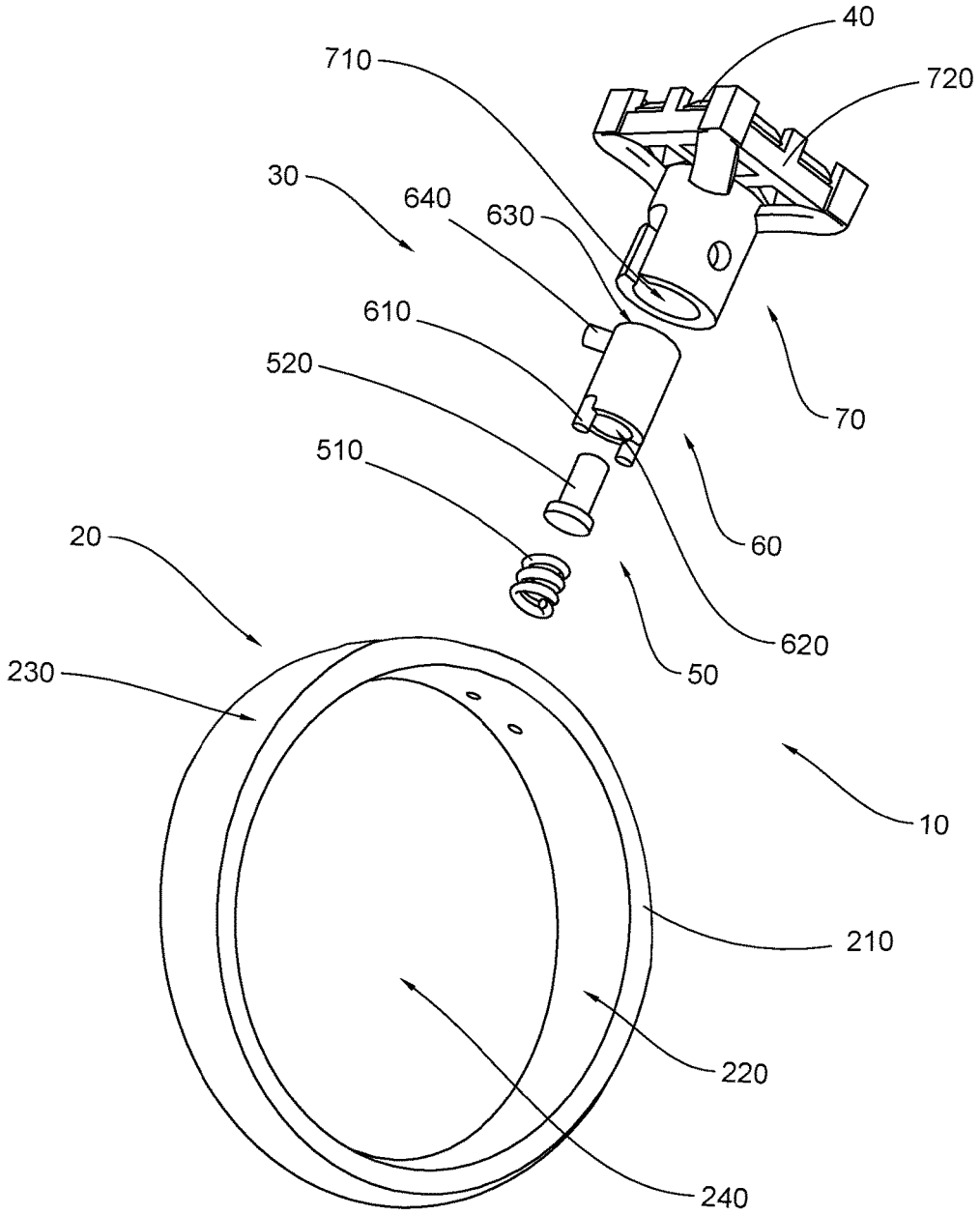
FIG. 1 is an exploded perspective view of an interchangeable ring according to the preferred embodiment of the present invention.

Referring to FIG. 1 of the drawings, an exploded perspective view of an interchangeable ring 10 according to the preferred embodiment of the present invention is illustrated. Broadly, the interchangeable ring 10 may comprise a main ring 20 and an interchangeable stone setter 30.

Referring to FIG. 1 of the drawings, the main ring 20 according to the preferred embodiment of the present invention may comprise a ring loop 210 formed by an enclosed loop of durable metal such as silver or gold. The ring loop 210 may further comprise an inner surface portion 220 and a through cavity 240 formed as a space surround by the inner surface portion 220 for insertion of the user's finger. The ring loop 210 may further comprise an outer surface portion 230 on which the interchangeable stone setter 30 may be provided.

Referring to FIG. 1 of the drawings, the interchangeable stone setter 30 may further comprise a spring loader 50, a connector 60, and an engaging stone setter 70. The spring loader 50 may further comprise a spring 510 and a pushing rod 520. An end of the spring 510 is provided on the outer surface portion 230 of the ring loop 210. The other end of the spring 510 engages with a bottom end of the pushing rod 520.

A bottom end of the connector 60 may have a first opening 620 which forms a hollow cavity for receiving the spring loader 50 inside. The connector 60 may further comprise a pair of stabilizing legs 610 provided at the bottom end at the outer edge of the first opening 620 which is adapted for inserting into a pair of holes provided on the outer surface portion 230 of the ring loop 210 for securing the interchangeable stone setter 30 on the main ring 20. A top end of the connector 60 may have a second opening 630 adapted for a portion of a top end of the pushing rod 520 to extend through. The connector 60 may further comprise a lock rod 640 protruding outwardly from the peripheral cylindrical surface of the connector 60.

Figure 2:
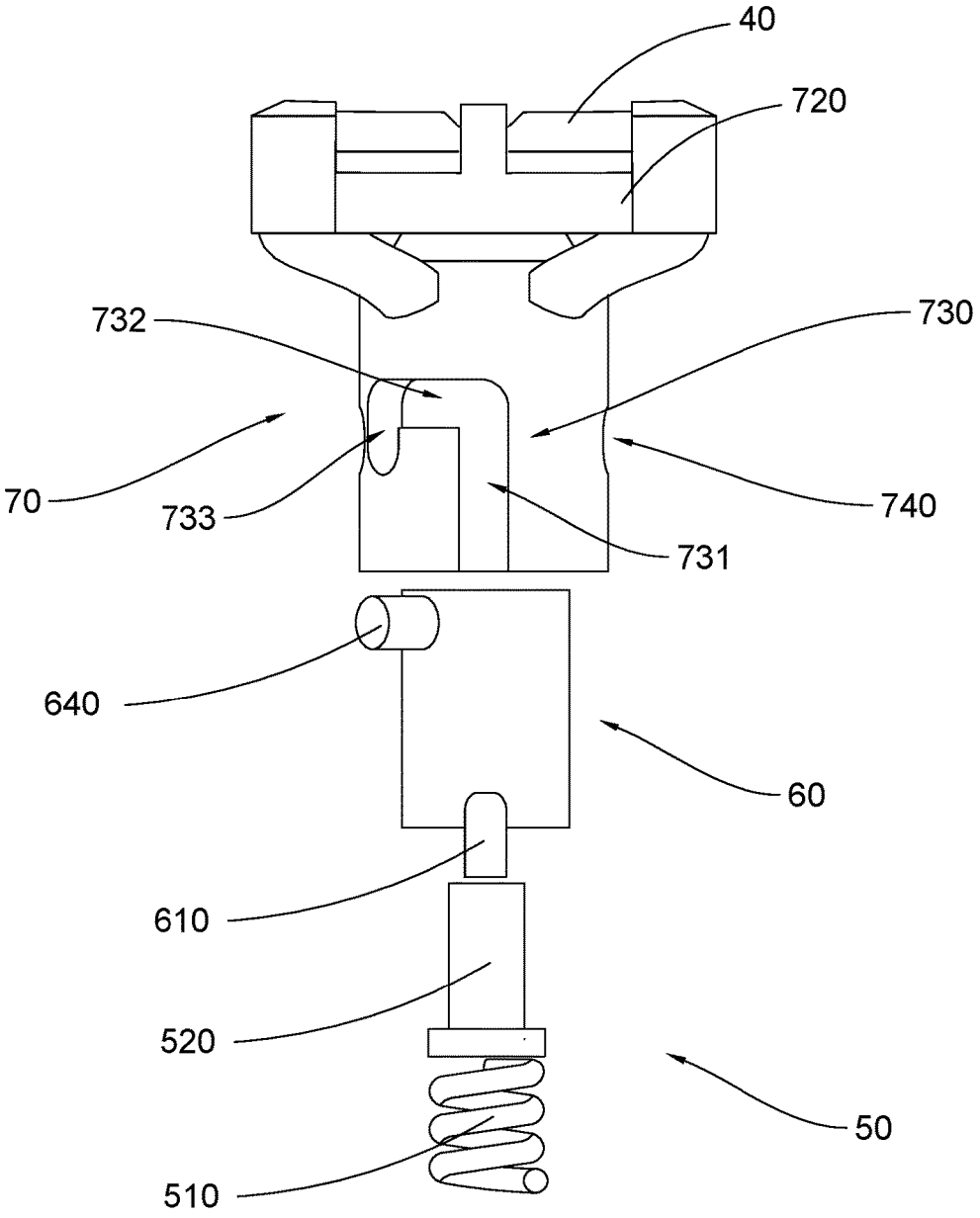
FIG. 2 is an exploded side view of the interchangeable stone setter according to the preferred embodiment of the present invention.

Referring to FIGS. 1 and 2 of the drawings, a bottom end of the engaging stone setter 70 may have a third opening 710 which forms a hollow cavity for receiving the connector 60. A top end of the engaging stone setter 70 is connected to an article platform 720 for setting an ornament article 40 for display purpose. The engaging stone setter 70 may further comprise a lock groove 730 provided on a peripheral cylindrical surface for engaging with the lock rod 640 of the connector 60. Referring to FIG. 2 of the drawings, an exploded side view of the spring loader 50, the connector 60, and the engaging stone setter 70 according to the preferred embodiment is illustrated. The lock groove 730 has an inverted "L" shape pattern adapted to receive the lock rod 640 to travel along the lock groove 730. The lock groove 730 may be divided into a vertical portion 731, a horizontal portion 732, and a lock portion 733.

Figure 3:
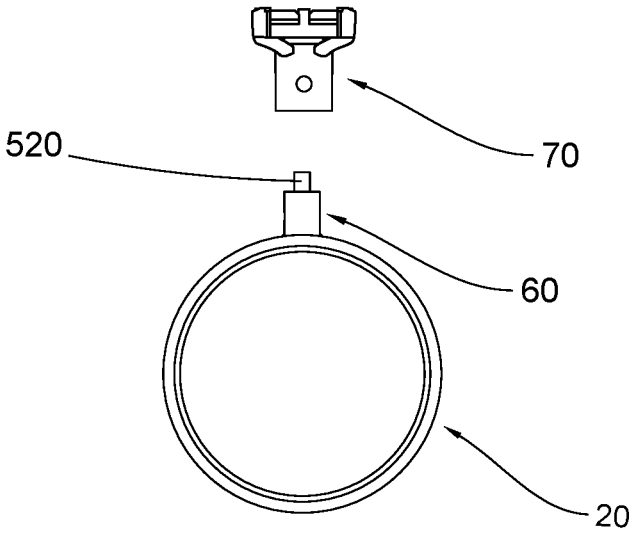
FIG. 3 is a side view of the interchangeable ring in the unengaged position according to the preferred embodiment of the present invention.
Figure 4:
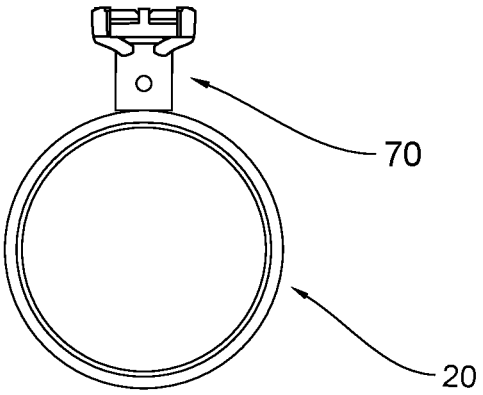
FIG. 4 is a side view of the interchangeable ring in the locking position according to the preferred embodiment of the present invention.

FIGS. 3 and 4 of the drawings illustrate that the interchangeable stone setter 30 is selectively configured between an unengaged position and a locking position respectively. The unengaged position is defined when the engaging stone setter 70 detaches from the connector 60. In order to move to the locking position, the engaging stone setter 70 is placed on top of the connector 60. The lock rod 640 and the lock groove 730 are aligned such that the lock rod 640 is arranged to travel along the vertical portion 731 of the lock groove 730. The top end of the pushing rod 520 is in contact with the ceiling of the third opening 710 of the engaging stone setter 70. The user must then exert a downward vertical force to push down the engaging stone setter 70 to compress the spring 510. While comprising the spring 510, the lock rod 640 may then travel down the end of the vertical portion 731 of the lock groove 730. While still pressing down the engaging stone setter 70 and compressing the spring 510, the user may then turn the engaging stone setter 70 in a counter-clockwise position such that the lock rod 640 may then travel along the horizontal portion 732 of the lock groove 730. When the lock rod 640 hits the end of the horizontal portion 732 of the lock groove 730, the user may then release the engaging stone setter 70 and the spring 510 will naturally unload itself by pushing the pushing rod 520 upwardly against the ceiling of the third opening 710 of the engaging stone setter 70. The lock rod 640 may then slide along the lock portion 733 of the lock groove 730 to be configured into the locking position. To go back to the unengaged position, the user may reverse the aforementioned actions by pressing down the engaging stone setter 60, turning the engaging stone setter 60 clockwise and releasing it.

Referring to FIG. 5 to FIG. 9 of the drawings, a second preferred embodiment of the present invention is illustrated. The structural and operational relationships between the main ring 20' and the interchangeable stone setter 30' remain the same as illustrated above.

Figure 5:
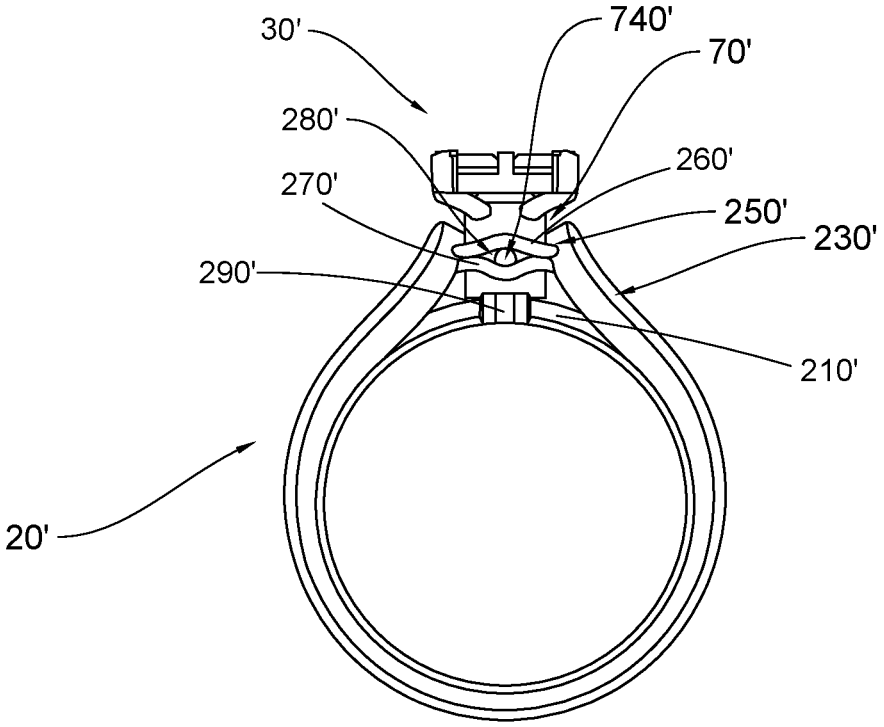
FIG. 5 is a side view of the interchangeable ring according to the second preferred embodiment of the present invention.
Figure 6:
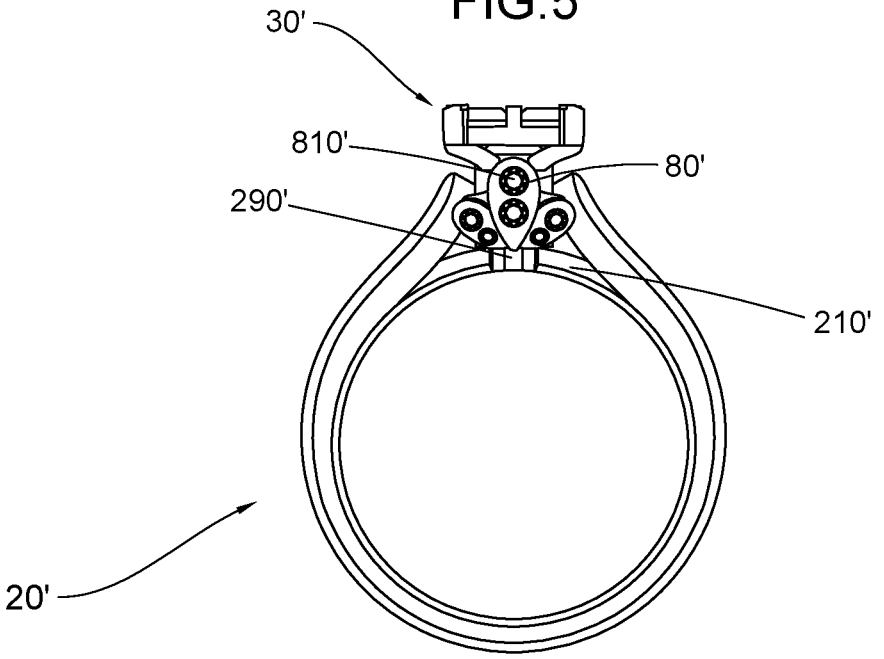
FIG. 6 is a side view of the interchangeable ring according to the second preferred embodiment of the present invention.

Referring to FIG. 5 of the drawings, a portion of the outer surface portion 230' is cut off at near the location where the interchangeable stone setter 30' is provided. Both end of the outer surface portion 230' splits off the ring loop 210' and bridges upwardly towards the top. A pair of locking lips 250' are provided at each end of the outer surface portion 230' in order to connect the two outer surface portions 230' on each side of the main ring 20'. The locking lips 250' may further comprise a first lip 260' and a second lip 270' forming a mouth shaped figure bridging the both end of the outer surface portions 230'. The locking lips 250' may further comprise a locking cavity 280' formed as a space surrounded by the first lip 260' and the second lip 270'. The ring loop 210' may further comprise a hinge 290' on each side of the main ring 20' near the location where the interchangeable stone setter 30' is provided. Referring to FIG. 6 of the drawings, the main ring 20' according to the second preferred embodiment of the present invention may further comprise a flipping protector 80' provided on each side of the main ring 20'. An end of the flipping protector 80' is connected to the hinge 290' on each side of the main ring 20' such that the flipping protector 80' can be flipped in a pivotal motion for protecting the interchangeable stone setter 30'. The flipping protector 80' has a front surface and a rear surface. A plurality of secondary ornament articles 810' are provided on the front surface of the flipping protector 80' for display purpose.

Figure 7:
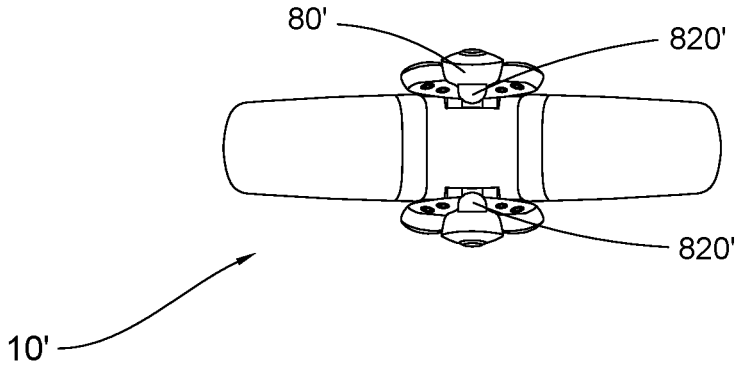
FIG. 7 is a top view of the interchangeable ring according to the second preferred embodiment of the present invention.
Figure 8:
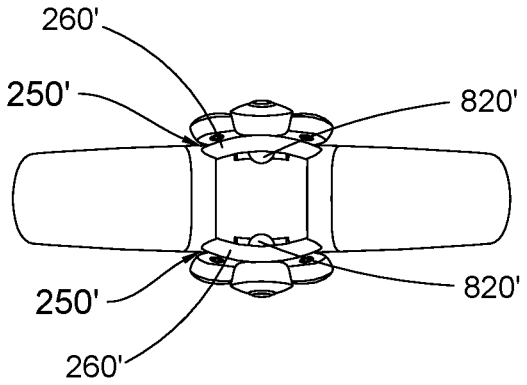
FIG. 8 is a top view of the interchangeable ring according to the second preferred embodiment of the present invention.

Referring to FIG. 7 of the drawings, a top view of the interchangeable ring 10' according to the second preferred embodiment of the present invention is illustrated. In this figure, the locking lips 250' and the interchangeable stone setter 30' are hidden for illustrative purpose. The flipping protector 80' may further comprise a locking sphere 820' provided on the rear surface of the flipping protector 80'. FIG. 8 of the drawings illustrates the same top view as FIG. 7 but with the locking lips 250' attached. The pair of first lips 260' are visible and shown in the top view. According to the second preferred embodiment of the present invention, when the user pivotally flips the flipping protector 80' upward, the locking sphere 820' will make contact with the locking lips 250'. In this position, the user may exert a force to press on the flipping protector 80' such that the locking sphere 820' can be squeezed into the locking cavity 280'. By pulling the flipping protector 80', the user may unlock it. Referring to FIG. 5 of the drawings, the engaging stone setter 70' according to the second preferred embodiment of the present invention may further comprise a pair of locking hole 740' provided on the peripheral cylindrical surface. In the locking position, the locking hole 740' aligns with the locking cavity 280' respectively on each side of the main ring 20'. When the locking sphere 820' is squeezed into the locking cavity 280', the locking hole 740' may receive a tip portion of the locking sphere 820' to help further stabilizing and retaining the interchangeable stone setter 30'.

Figure 9:
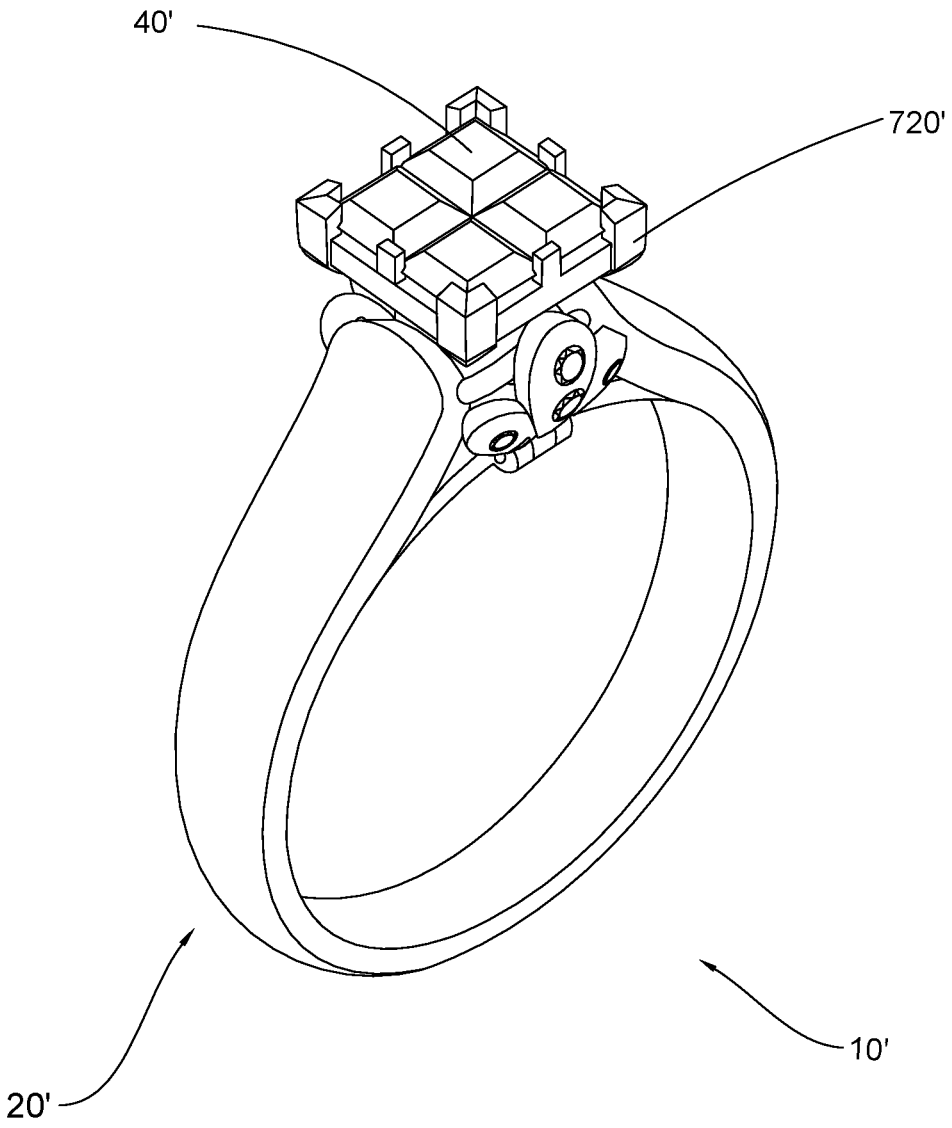
FIG. 9 is a perspective view of the interchangeable ring in the locking position according to the second preferred embodiment of the present invention.
Figure 10:
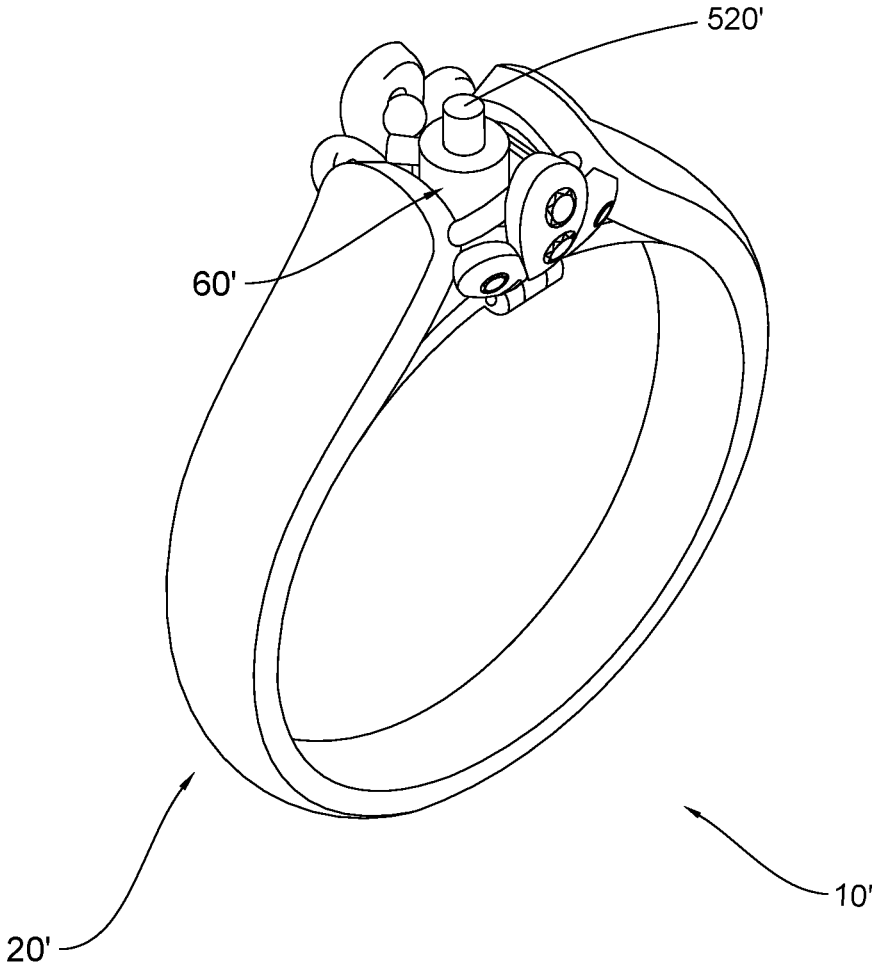
FIG. 10 is a perspective view of the interchangeable ring in the unengaged position according to the second preferred embodiment of the present invention.
Figure 11:
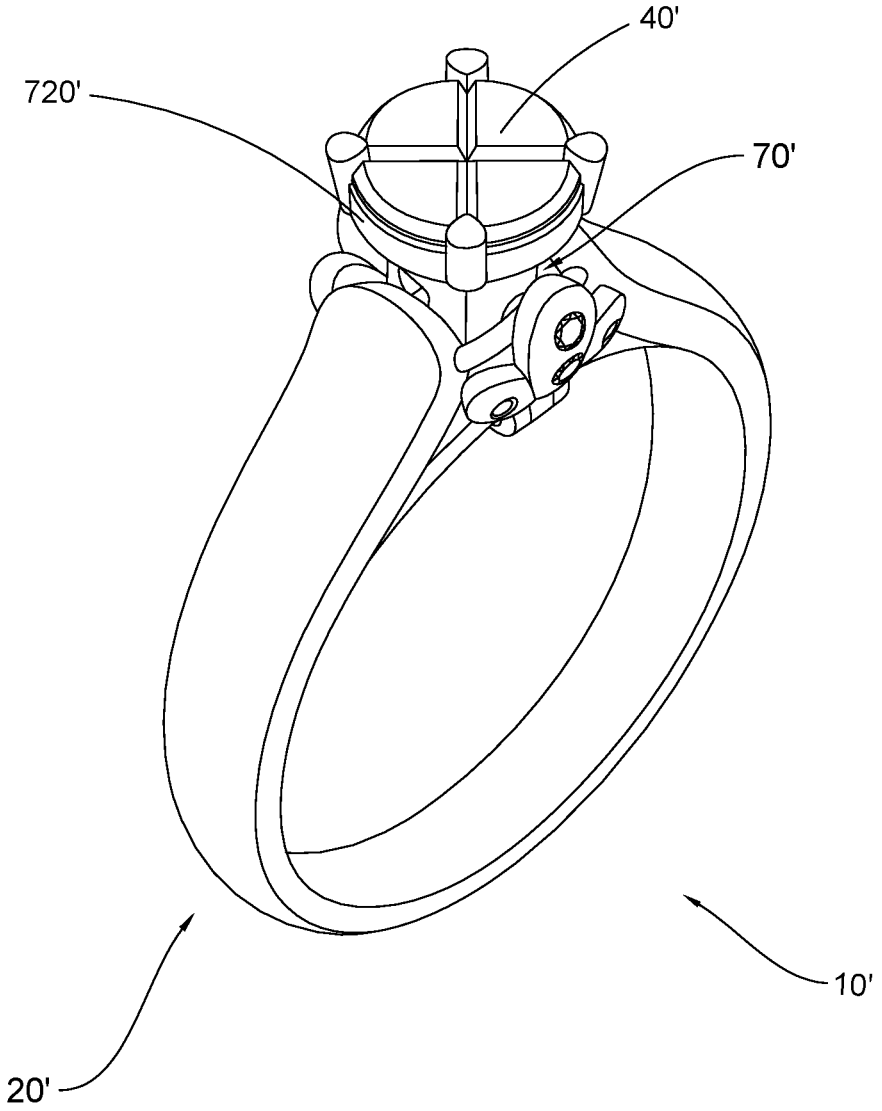
FIG. 11 is a perspective view of the interchangeable ring illustrating that a different engaging stone setter can be interchanged for display purpose and user customization.

FIG. 9 of the drawings illustrates a perspective view of the interchangeable ring 10' in the locking position according to the second preferred embodiment of the present invention. FIG. 10 of the drawings illustrates the same perspective view of the interchangeable ring 10' in the unengaged position. In the unengaged position, the engaging stone setter 70' is detached from the connector 60'. FIG. 11 of the drawings illustrates that a different looking engaging stone setter 70' is engaged in the locking position. The engaging stone setter 70' illustrated in this figure has a circular shape article platform 720' with circular shape article ornaments 40' installed therein while the previously illustrated article platform 720' and ornament article 40' from FIG. 9 of the drawings are square in shape. According to the configuration in FIG. 11 of the drawings, it can be seen that a user may interchange a different set of engaging stone setter 70' such that a different cosmetic looking article platform 720' and ornament article 40' can be displayed as a customization of the present invention.

The present invention, while illustrated and described in terms of different preferred embodiments, is not limited to the particular description contained in this specification. Additional alternative or equivalent components could also be used to practice the present invention.

What is claimed is:

1. An interchangeable ring, comprising:

a main ring having a ring loop, wherein said ring loop has an inner surface portion, an outer surface portion, and a through cavity formed as a space surrounded by said inner surface portion;

an interchangeable stone setter provided on said outer surface portion of said main ring, and comprising:

a spring loader operatively engaged with said main ring;

a connector connected to said spring loader;

an engaging stone setter selectively connected to said connector, said engaging stone setter comprising an article platform provided at a top end thereof for setting an ornament article;

a lock groove provided on said engaging stone setter and is divided into a vertical portion, a horizontal portion and a lock portion;

a lock rod protruded outwardly from a peripheral cylindrical surface of said connector; and a pair of stabilizing legs provided at a bottom end of said connector and adapted for inserting into a pair of holes provided on said outer surface portion of the ring loop, wherein said interchangeable stone setter is selectively configured between an unengaged position which said engaging stone setter detaches from said connector by use of said spring loader, and a locking position which said connector engages with said engaging stone setter by use of said spring loader;

said lock rod is arranged to travel along said lock groove to move between said unengaged position and said locking position; and said lock rod is arranged to travel sequentially along said vertical portion, said horizontal portion, and said lock portion for engaging said engaging stone setter with said connector in said locking position, and is arranged to travel sequentially along said lock portion, said horizontal portion, and said horizontal portion for detaching said engaging stone setter with said connector in said unengaged position;

wherein said outer surface portion comprises a pair of locking lips provided on said outer surface portion, and a pair of flipping protector pivotally provided on said main ring and is adapted to engage with said locking lips;

said locking lips comprises a first lip and a second lip forming a mouth shaped figure bridging both end of said outer surface portion and a locking cavity formed as a space surrounded by said first lip and said second lip; and said flipping protector comprises a locking sphere provided on a rear surface of said flipping protector adapted to be received into said locking cavity when said flipping protector engages with said locking lips and a plurality of secondary ornament articles provided on a front surface of said flipping protector.

2. The interchangeable ring, as recited in claim 1, comprising a pair of locking hole provided on a peripheral cylindrical surface of said engaging stone setter.

* * * * *